US007847780B2

(12) United States Patent
Chang

(10) Patent No.: US 7,847,780 B2
(45) Date of Patent: Dec. 7, 2010

(54) METHOD FOR DRIVING A DISPLAY PANEL

(75) Inventor: Kuei-Kai Chang, Hsinchu County (TW)

(73) Assignee: Orise Technology Co., Ltd., Hsinchu (TW)

( * ) Notice: Subject to any disclaimer, the term of this patent is extended or adjusted under 35 U.S.C. 154(b) by 879 days.

(21) Appl. No.: 11/747,775

(22) Filed: May 11, 2007

(65) Prior Publication Data

US 2008/0224984 A1 Sep. 18, 2008

(30) Foreign Application Priority Data

Mar. 12, 2007 (TW) ..... 96108408 A

(51) Int. Cl.
*G09G 3/36* (2006.01)

(52) U.S. Cl. ..... 345/100; 345/96

(58) Field of Classification Search ..... 345/87–102, 345/204

See application file for complete search history.

(56) References Cited

U.S. PATENT DOCUMENTS 4,842,371 A 6/1989 Yasuda et al.
5,657,040 A 8/1997 Kanbara
5,724,061 A 3/1998 Kanbara
5,805,128 A 9/1998 Kim et al.
6,768,482 B2 * 7/2004 Asano et al. ..... 345/90
6,980,266 B2 * 12/2005 Choi ..... 349/106
7,268,761 B2 * 9/2007 Ishiyama ..... 345/96
7,528,819 B2 * 5/2009 Lin et al. ..... 345/100
2002/0140655 A1 * 10/2002 Liang et al. ..... 345/89
2004/0178981 A1 * 9/2004 Asada et al. ..... 345/96
2005/0099378 A1 * 5/2005 Kim ..... 345/99
2007/0013639 A1 * 1/2007 Lin et al. ..... 345/100
2007/0262941 A1 * 11/2007 Jan et al. ..... 345/96

* cited by examiner

*Primary Examiner*—Nitin Patel
(74) *Attorney, Agent, or Firm*—J.C. Patents

(57) ABSTRACT

A method for driving a display panel is provided. The display panel includes a first scan line, and the first scan line includes sub-pixels. A first portion of the sub-pixels is controlled by a first gate line, and a second portion of the sub-pixels is controlled by a second gate line. The arrangement of the sub-pixels of the first portion and the second portion are in an interlaced arrangement. The method includes the following steps. First, drive the first gate line and then drive the second gate line in a first image duration. Then, drive the second gate line and then drive the first gate line in a second image duration.

29 Claims, 17 Drawing Sheets

METHOD FOR DRIVING A DISPLAY PANEL

CROSS-REFERENCE TO RELATED APPLICATION

This application claims the priority benefit of Taiwan application serial no. 96108408, filed Mar. 12, 2007. All disclosure of the Taiwan application is incorporated herein by reference.

BACKGROUND OF THE INVENTION

1. Field of the Invention

The present invention relates to a driving method, and more particularly to a method for driving a display panel.

2. Description of Related Art

Conventionally, in the thin-film transistor liquid crystal display (TFT-LCD) panel, M×N sub-pixels need to use M source lines and N gate lines for controlling. Both M and N are natural numbers. Currently, a new driving technique has been developed, wherein the required source lines are reduced by half and the required gate lines are doubled so as to control a panel with M×N sub-pixels. A panel adopting this new technique is called a half-source-double-gate type panel.

Since M is several times more than N, the advantage derived from adopting the new technique is substantially reducing the number of the output pins which control the source driver chips of the source lines thereby reducing the chip areas and lowering the fabricating cost. Additionally, the new technique can also lower the direct current, and increase the flexibility in the panel layout, such as disposing a chip on the left or right side of the panel.

However, this new type of panel still uses the driving timing of the gate line in the old panel, which results in the phenomenon of vertical bright and dim stripes while displaying the same gray level and thereby lowering the frame quality. A new type of panel adopting the line inversion technique and a common potential of an alternating current as well as a new type of panel adopting the dot inversion technique and a common potential of a direct current are taken as examples to illustrate the present invention in the following. It is assumed that both new types of panels adopt the normally black state at the display mode.

FIG. 1 is a schematic diagram illustrating a half-source-double-gate type panel adopting the line inversion technique. The panel in FIG. 1 also uses an alternating current common potential and includes N scan lines, M/2 source lines and 2N gate lines, respectively indicated as L1-L(N), S1-S(M/2) and G1-S(2N). Each of the scan lines includes M sub-pixels 101 and the displayed colors of adjacent sub-pixels on the same scan line are different from each other. R represents red sub-pixels 101, G represents green sub-pixels 101, and B represents blue sub-pixels 101.

FIG. 2 is the timing diagram of each of the signals in the panel of FIG. 1. The VCOM in FIG. 2 refers to a common potential, and all the other reference labels correspond to those in FIG. 1. It can be known from FIG. 2 that the gate lines G1-G(2N) are sequentially driven one by one, which means adopting the driving timing of the old gate lines and simultaneously transmitting frame data to the corresponding sub-pixels through the source lines in the order of turning on the gate lines. For example, when the gate line G1 is driven to turn on the sub-pixels 101 coupled to the gate line G1, the source lines S1-S(M/2) transmit accordingly the frame data required by the turned-on sub-pixels. When the gate line G2 is driven to turn on the sub-pixels 101 coupled to the gate line G2, the source lines S1-S(M/2) transmit accordingly the frame data required by the turned-on sub-pixels.

Nevertheless, since the line inversion technique is adopted, when the gate lines of the same scan line are driven, the alternating current common potentials will be of the same polarity, as shown in FIG. 3. FIG. 3 is a diagram illustrating the changes in polarity of the common potentials of each of the scan lines and each of the source lines in FIG. 2. Referring to FIG. 3, taking the scan line L1 as an example, when the gate line G1 is driven, the common potential VCOM changes its polarity, and hence can only achieve a stable level after a period of time. When the gate line G2 is driven, the polarity does not need to change and therefore the common potential is always maintained at a stable level of the same polarity. It can be known that the voltage difference between the frame signal and the common potential when the gate line G1 is driven is smaller than the voltage difference between the frame signal and the common potential when the gate line G2 is driven. Thus, the luminance of the sub-pixels turned on by the gate line G1 is smaller than the luminance of the sub-pixels turned on by the gate line G2. Certainly, in reality, when the gate line G1 is driven, the common potential VCOM does not necessarily vary as the waveform shown in FIG. 3. However, to sum it up, the voltage difference between the frame signal and the common potential when the gate line G1 is driven and the voltage difference between the frame signal and the common potential when the gate line G2 is driven are different. Similarly, the same situation also happens to the scan lines L2-L(N). When the driving timing of the old gate lines is adopted, the visual phenomenon of vertical bright and dim stripes would occur.

FIG. 4 is a schematic diagram illustrating a half-source-double-gate type panel adopting the dot inversion technique. The panel of FIG. 4 also adopts a direct current common potential. As to the hardware structure of the panel, it is the same as the hardware structure shown in FIG. 1 and thus is not to be reiterated herein. In order to better illustrate, the source lines S1 and S2 and the gate lines G1-G4 are taken as examples to describe the old operation method, as shown in FIG. 5. FIG. 5 is a diagram showing the changes in polarity of the source lines S1 and S2 and the timing of the gate lines G1-G4 of FIG. 4. N in FIG. 4 may represent the integer 0 or a natural number. If N is 0, 4N+1, 4N+2, 4N+3 and 4N+4 represent respectively the first, the second, the third and the fourth image durations. If N is 1, 4N+1, 4N+2, 4N+3 and 4N+4 represent respectively the fifth, the sixth, the seventh and the eighth image durations. The same applies to all the rest. The gate lines G1-G4 are sequentially driven one by one, which means adopting the driving timing of the old gate lines.

It is found in FIG. 5 that during whichever image duration, when the gate lines G2 and G4 are driven, both source lines S1 and S2 just change polarities, and therefore the levels of the common potential VCOM would be affected at the moment. Taking the $4N+1^{th}$ image duration as an example, when the gate line G2 is driven, the source lines S1 and S2 just change from the positive to the negative polarity, and thus the level of the common potential on the liquid crystal panel would be slightly pulled to the negative polarity. When the gate line G4 is driven, the polarities of the source lines S1 and S2 just change from negative to positive, and therefore the level of the common potential on the liquid crystal panel would be slightly pulled to the positive polarity. Hence, the voltage differences between the source lines S1, S2 and the common potential VCOM when the gate lines G2 and G4 are driven are smaller than the voltage differences between the source lines S1, S2 and the common potential VCOM when the gate lines G1 and G3 are driven. Similarly, the same situation also arises during the $4N+2^{th}$ to the $4N+4^{th}$ image durations. When the driving timing of the old gate lines is adopted, the visual phenomenon of vertical bright and dim stripes would occur.

SUMMARY OF THE INVENTION

A method for driving a display panel is provided in the present invention. The method can mitigate the problem of vertical bright and dim stripes of a half-source-double-gate type panel thereby improving the frame quality of the new type of panel.

As broadly described herein, a method for driving a display panel is disclosed in the present invention. The display panel includes a first scan line, and the first scan line includes a plurality of sub-pixels. A first portion of the sub-pixels is controlled by a first gate line, and a second portion of the sub-pixels is controlled by a second gate line. The first portion sub-pixels and the second portion sub-pixels are in an interlaced arrangement. The method includes the following steps. At the beginning, during a first image duration, the first gate line is driven first, and then the second gate line is driven. Afterwards, during a second image duration, the second gate line is driven first, and then the first gate line is driven.

The display panel further includes a second scan line, and the second scan line includes a plurality of sub-pixels. The sub-pixels are divided into a third portion and a fourth portion, and the third portion is controlled by a third gate line and the fourth portion is controlled by a fourth gate line. The sub-pixels of the third portion and those of the fourth portion are in an interlaced arrangement.

According to a driving method of a display panel in one embodiment of the invention, the second image duration follows the first image duration, the third image duration precedes the first image duration, and the fourth image duration follows the second image duration. During the first and the third image durations, the first gate line, the second gate line, the third gate line and the fourth gate line are driven in sequence. During the second and the fourth image durations, the second gate line, the first gate line, the fourth gate line and third gate line are driven in sequence.

According to a driving method of a display panel in another embodiment of the invention, the second image duration follows the first image duration, the third image duration follows the second image duration, and the fourth image duration follows the third image duration. During the first and the third image durations, the first gate line, the second gate line, the third gate line and the fourth gate line are driven in sequence. During the second and the fourth image durations, the second gate line, the first gate line, the fourth gate line and third gate line are driven in sequence.

According to a driving method of a display panel in yet another embodiment of the invention, the second image duration follows the first image duration, the third image duration follows the second image duration, and the fourth image duration follows the third image duration. During the first and the fourth image durations, the first gate line, the second gate line, the third gate line and the fourth gate line are driven in sequence. During the second and the third image durations, the second gate line, the first gate line, the fourth gate line and third gate line are driven in sequence.

In the driving method of the invention, the gate lines corresponding to the same scan line are driven in different sequences during different image durations. Therefore, the problem of vertical bright and dim stripes caused by uneven brightness and dimness is mitigated.

In order to the make the aforementioned and other objects, features and advantages of the present invention more comprehensible, preferred embodiments accompanied with figures are described in detail below.

DESCRIPTION OF EMBODIMENTS

In order to facilitate illustration, all the display panels described in the following embodiments are the new half-source-double-gate type panels and adopt the display mode of a normally black state. In addition, the new type of panels in the following embodiments will adopt respectively the line inversion technique with an alternating current common potential or the dot inversion technique with a direct current common potential to illustrate the present invention. Since the hardware structure of the new type of panel has already been shown in FIG. 1 or FIG. 4, the hardware structure is not to be reiterated in the descriptions of the following embodiments. Please refer to FIG. 1 or FIG. 4 according to the descriptions.

Figure 1:
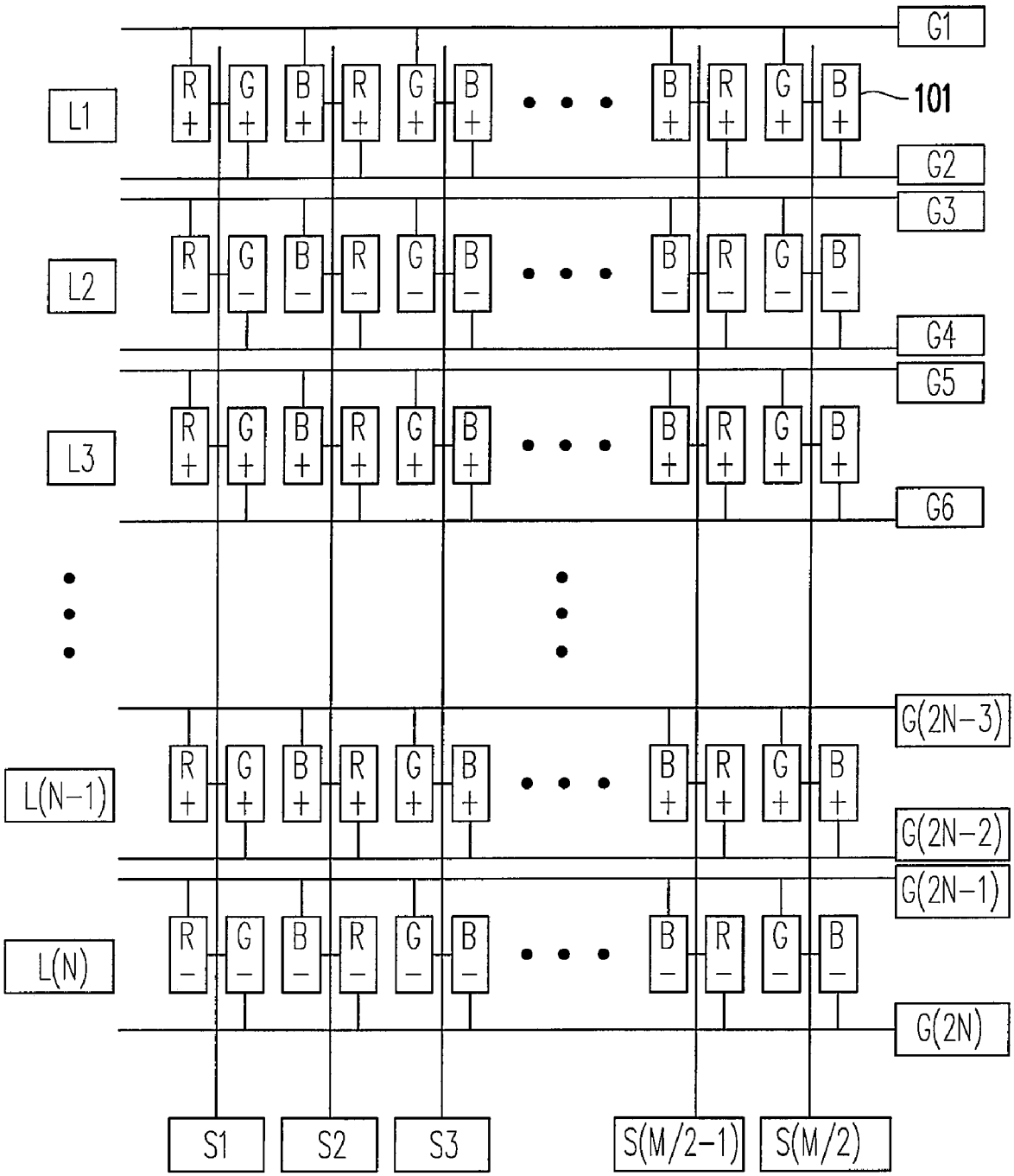
FIG. 1 (PRIOR ART)
FIG. 1 is a schematic diagram illustrating a half-source-double-gate type panel adopting the line inversion technique.
Figure 2:
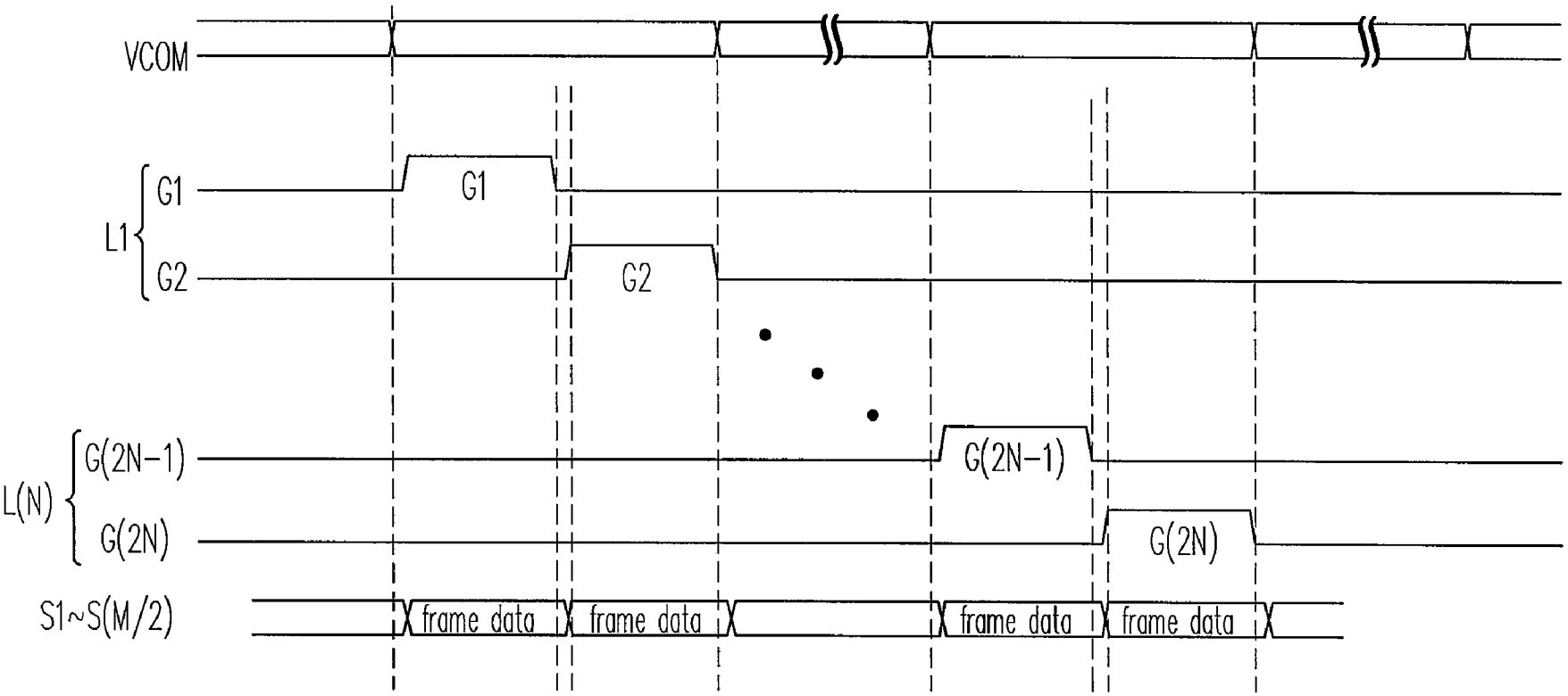
FIG. 2 (PRIOR ART)
FIG. 2 is the timing diagram of each of the signals in the panel of FIG. 1.
Figure 3:
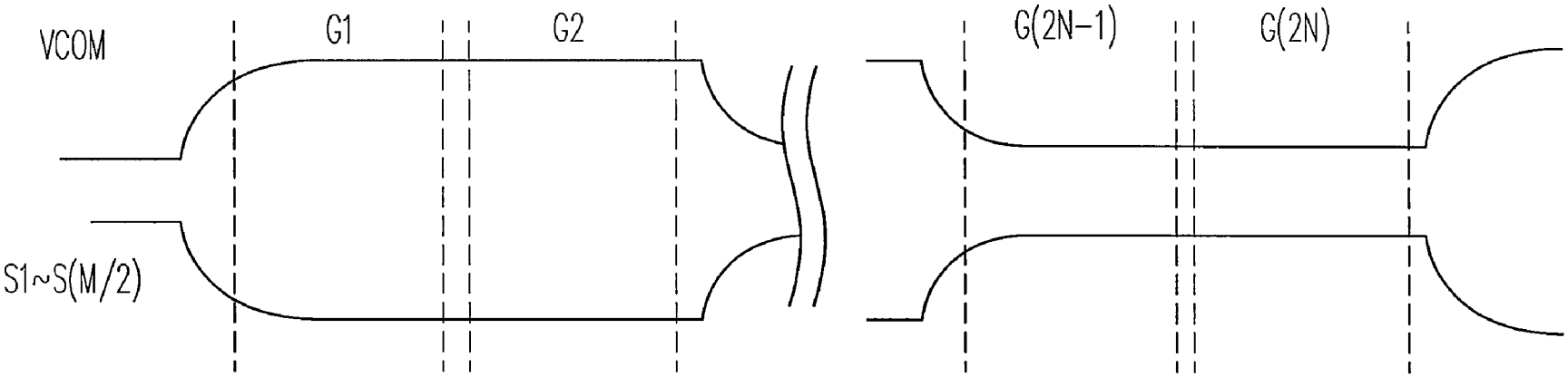
FIG. 3 (PRIOR ART)
FIG. 3 is a diagram illustrating the common potentials of each of the scan lines and the changes in polarity of each of the source lines in FIG. 2.
Figure 6:
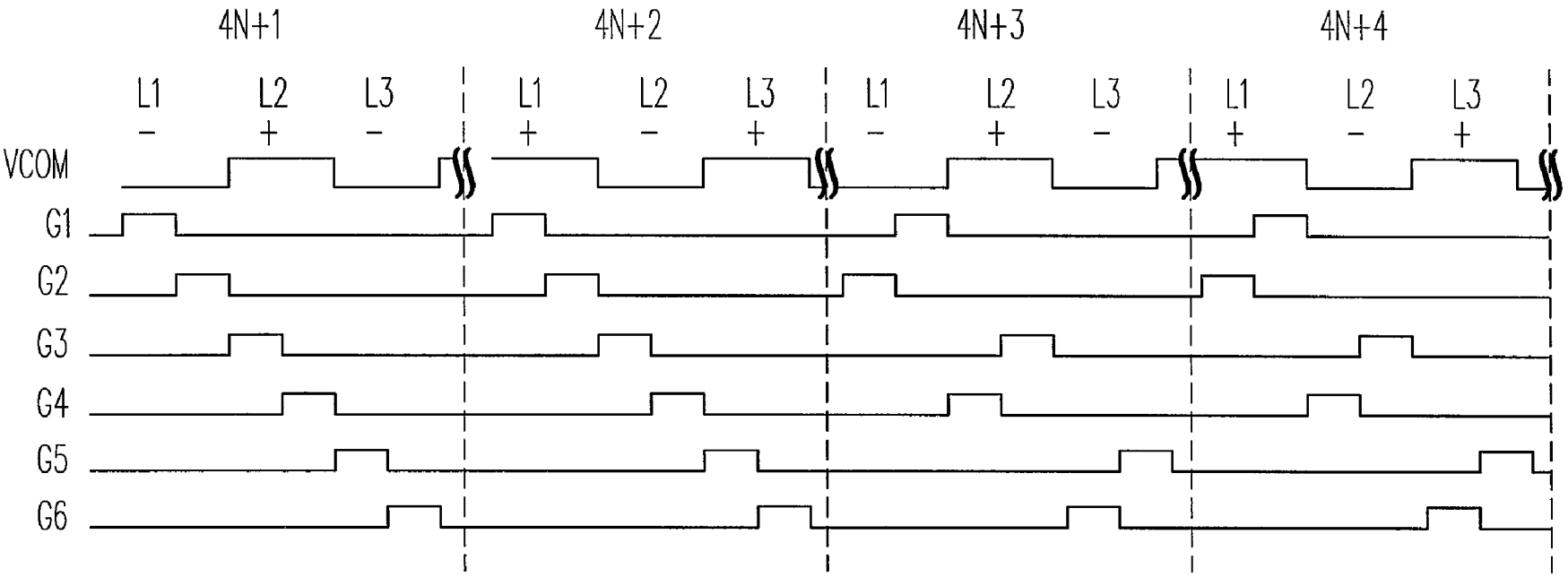
FIG. 6 is a method for driving a display panel according to one embodiment of the present invention.

If the half-source-double-gate type panel adopts the line inversion technique and an alternating current common potential as shown in FIG. 1, then one of the solutions to the phenomenon of vertical bright and dim stripes is as that shown in FIG. 6. FIG. 6 illustrates the polarity of the common potential VCOM of the scan lines L1-L3 during the $4N+1^{th}$ to the $4N+4^{th}$ image durations and the driving sequences in which the gate lines G1-G6 are driven during the $4N+1^{th}$ to the $4N+4^{th}$ image durations according to one embodiment of the invention. N in FIG. 6 may represent the integer 0 or a natural number. If N is 0, 4N+1, 4N+2, 4N+3 and 4N+4 represent respectively the first, the second, the third and the fourth image durations. If N is 1, 4N+1, 4N+2, 4N+3 and 4N+4 represent respectively the fifth, the sixth, the seventh and the eighth image durations. The same applies to all the rest. Furthermore, the VCOM in FIG. 6 refers to a common potential, and all the other reference labels correspond to those in FIG. 1.

In FIG. 6, during the $4N+1^{th}$ and the $4N+2^{th}$ image durations, the gate lines G1-G6 are sequentially driven one by one. However, during the $4N+3^{th}$ and the $4N+4^{th}$ image durations, the driving sequences of the gate lines corresponding to the same scan line are changed. Therefore, during the $4N+1^{th}$ and the $4N+2^{th}$ image durations, the voltage difference between the frame signal and the common potential when the gate lines G1, G3 and G5 are driven is smaller than the voltage difference between the frame signal and the common potential when the gate lines G2, G4 and G6 are driven.

The luminance of the sub-pixels turned on by the gate lines G1, G3 and G5 is smaller than the luminance of the sub-pixels turned on by the gate lines G2, G4 and G6.

Similarly, during the $4N+3^{th}$ and the $4N+4^{th}$ image durations, the voltage differences between the frame signals and the common potentials when the gate lines G2, G4 and G6 are driven are smaller than the voltage differences between the frame signals and the common potentials when the gate lines G1, G3 and G5 are driven. The luminance of the sub-pixels turned on by the gate lines G2, G4 and G6 is smaller than the luminance of the sub-pixels turned on by the gate lines G1, G3 and G5. It can be inferred that the operation method can mitigate the phenomenon of vertical bright and dim stripes derived from uneven brightness and dimness.

Figure 7:
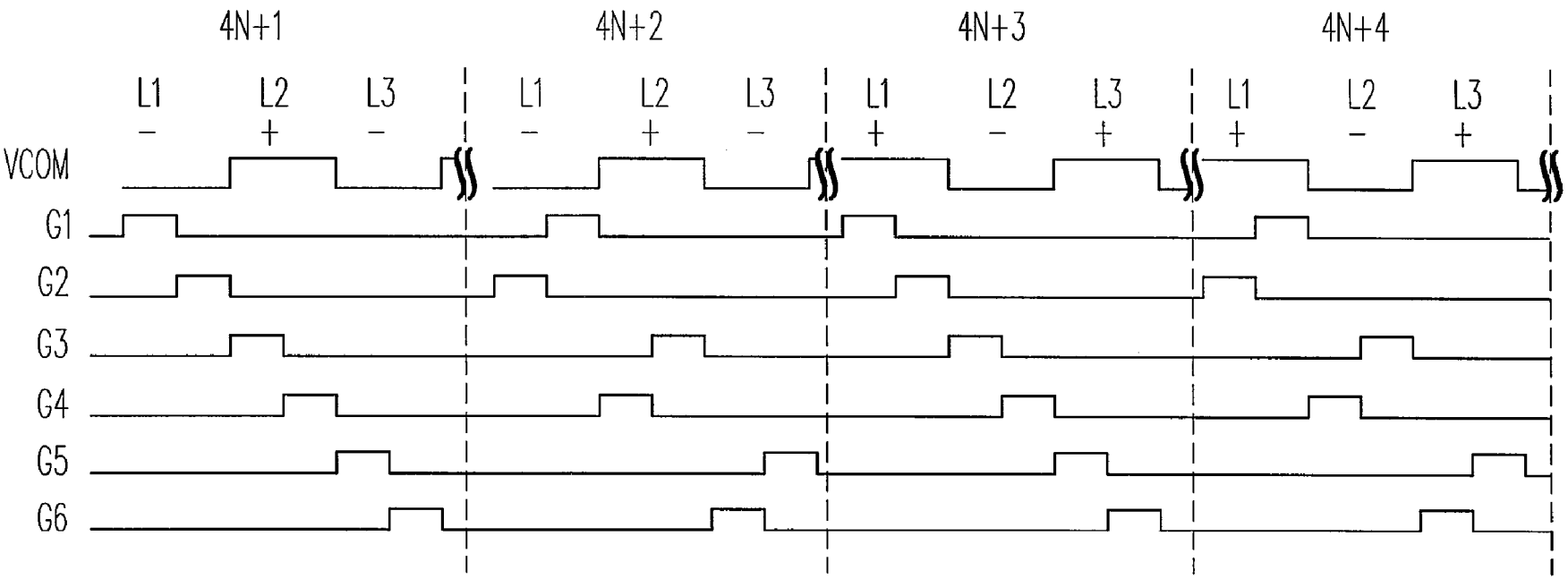
FIG. 7 is a method for driving a display panel according to another embodiment of the invention.

Since the line inversion technique does not require the polarity of the common potential of the same scan line be changed every time when the frame is updated, the polarity may also be inverted every two frames. Under such circumstances, the problem of vertical bright and dim stripes can be mitigated in the way as shown in FIG. 7. FIG. 7 illustrates the polarity of the common potential VCOM of the scan lines L1-L3 during the $4N+1^{th}$ to the $4N+4^{th}$ image durations and the driving sequences in which the gate lines G1-G6 are driven during the $4N+1^{th}$ to the $4N+4^{th}$ image durations according to a driving method of a display panel of another embodiment of the invention. The VCOM in FIG. 7 refers to a common potential, and all the other reference labels correspond to those in FIG. 1.

In FIG. 7, during the $4N+1^{th}$ and $4N+3^{th}$ image durations, the gate lines G1-G6 are sequentially driven one by one. However, during the $4N+2^{th}$ and the $4N+4^{th}$ image durations, the driving sequence of the gate lines corresponding to the same scan line is changed. Therefore, during the $4N+1^{th}$ and the $4N+3^{th}$ image durations, the voltage differences between the frame signals and the common potentials when the gate lines G1, G3 and G5 are driven are smaller than the voltage differences between the frame signals and the common potentials when the gate lines G2, G4 and G6 are driven.

Thus, the luminance of the sub-pixels turned on by the gate lines G1, G3 and G5 is smaller than the luminance of the sub-pixels turned on by the gate lines G2, G4 and G6.

Similarly, during the $4N+2^{th}$ and the $4N+4^{th}$ image durations, the voltage differences between the frame signals and the common potentials when the gate lines G2, G4 and G6 are driven are smaller than the voltage differences between the frame signals and the common potentials when the gate lines G1, G3 and G5 are driven. Thus, the luminance of the sub-pixels turned on by the gate lines G2, G4 and G6 is smaller than the luminance of the sub-pixels turned on by the gate lines G1, G3 and G5. It can be inferred that the operation method can mitigate the phenomenon of vertical bright and dim stripes caused by uneven brightness and dimness.

Certainly, in the two said embodiments, the source lines S1-S3 transmit the frame signals correspondingly in the driving sequences of the gate lines G1-G6 so as to display normal frames.

It should be noted that during the $4N+1^{th}$ and the $4N+3^{th}$ image durations in FIG. 6, the polarities of the alternating current common potential of the same scan line are the same. During the $4N+2^{th}$ and the $4N+4^{th}$ image durations, the polarities of the alternating current common potential of the same scan line are also the same, but the polarity at the moment is opposite to the polarity during the $4N+1^{th}$ and the $4N+3^{th}$ image durations. Moreover, during the $4N+1^{th}$ and the $4N+2^{th}$ image durations in FIG. 7, the polarities of the alternating current common potential of the same scan line are the same. During the $4N+3^{th}$ and the $4N+4^{th}$ image durations, the polarities of the alternating current common potential of the same scan line are also the same, but the polarity at the moment is opposite to the polarity during the $4N+1^{th}$ and the $4N+2^{th}$ image durations. With this principle, the user should be able to further infer from the above teachings and demonstrations and apply the invention to other line inversion techniques.

Figure 4:
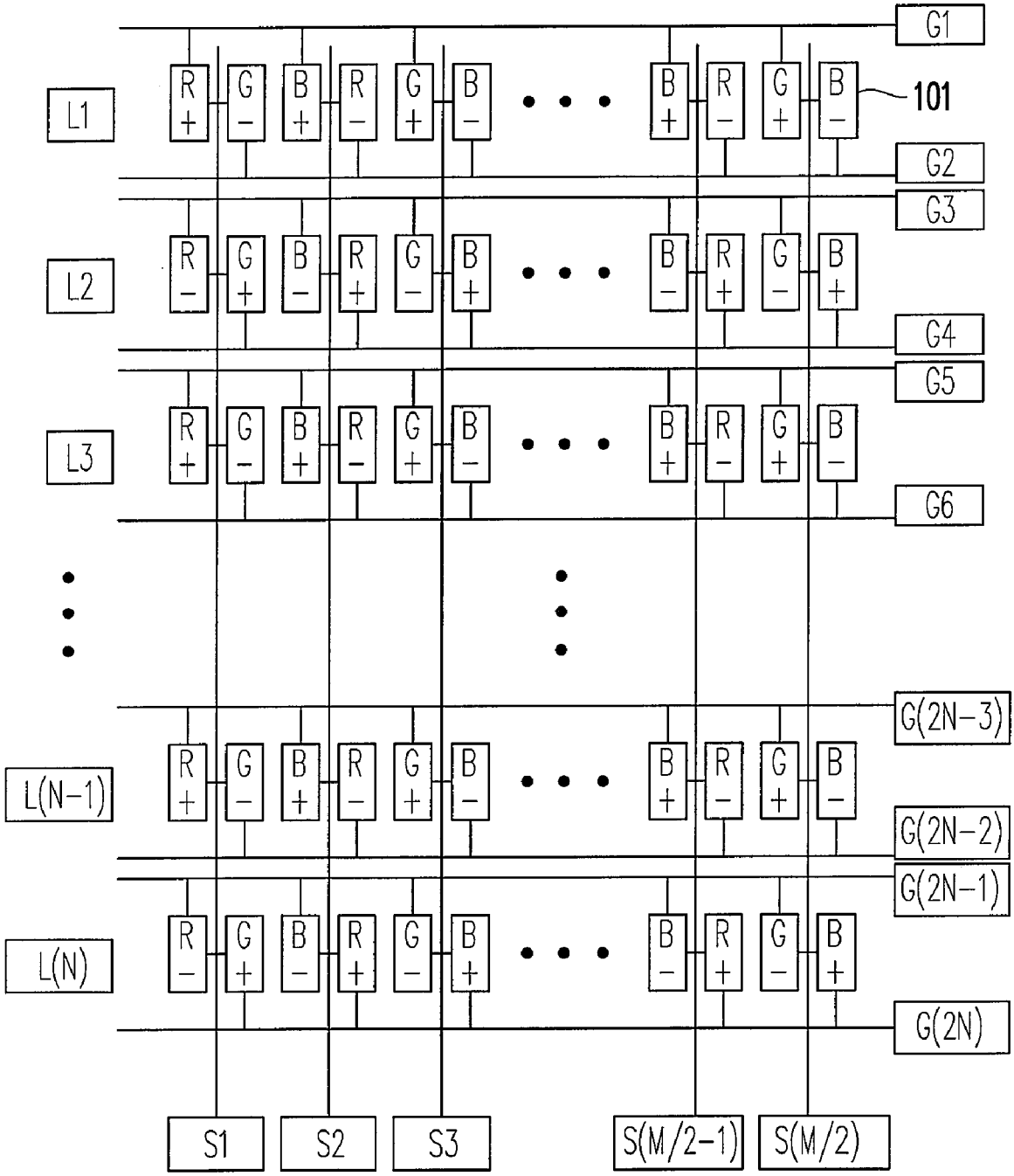
FIG. 4 (PRIOR ART)
FIG. 4 is a schematic diagram illustrating a half-source-double-gate type panel adopting the dot inversion technique.
Figure 5:
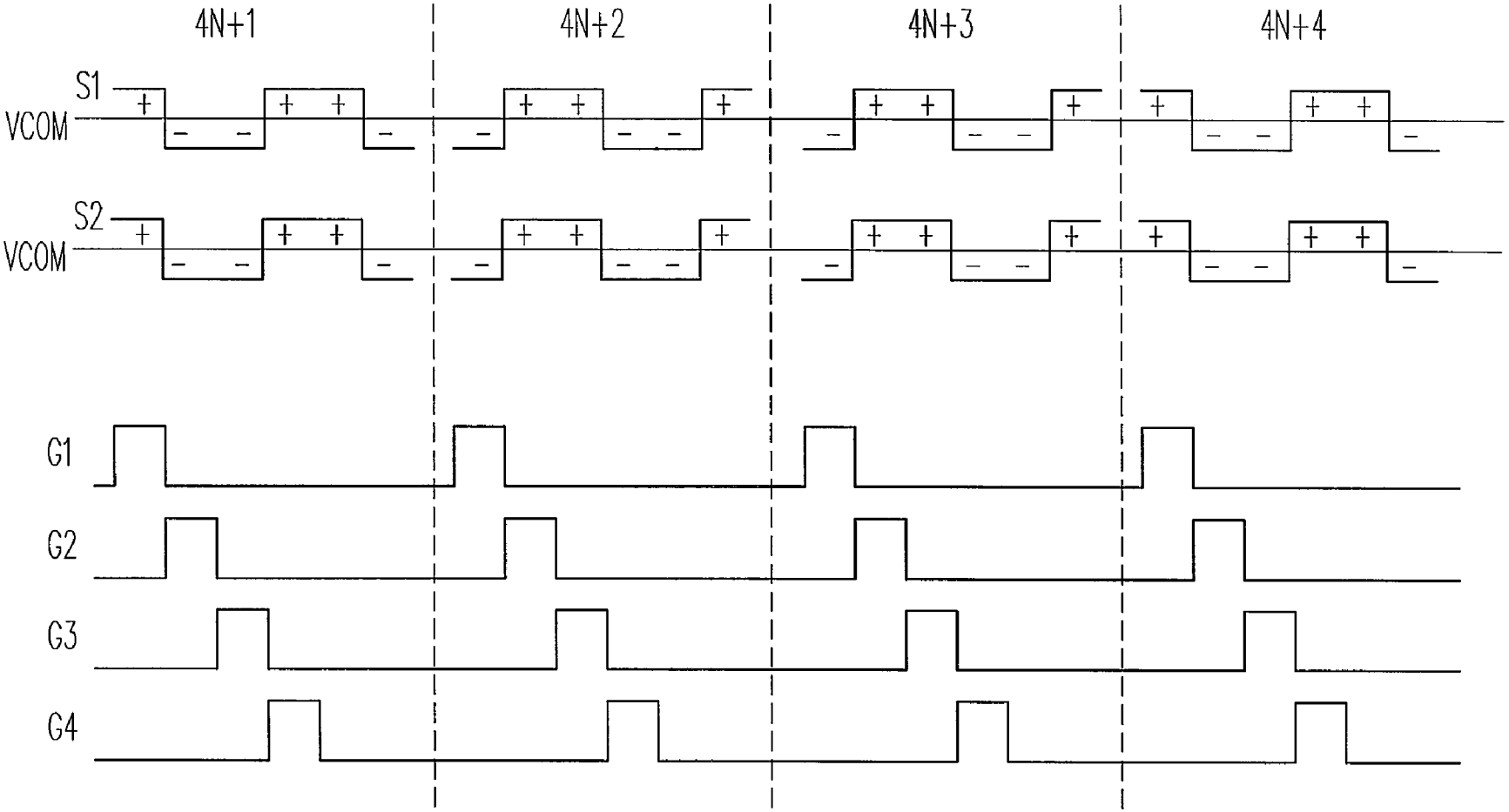
FIG. 5 (PRIOR ART)
FIG. 5 is a diagram showing the changes in polarity of the source lines S1 and S2 as well as the timing of the gate lines G1-G4 of FIG. 4.
Figure 8:
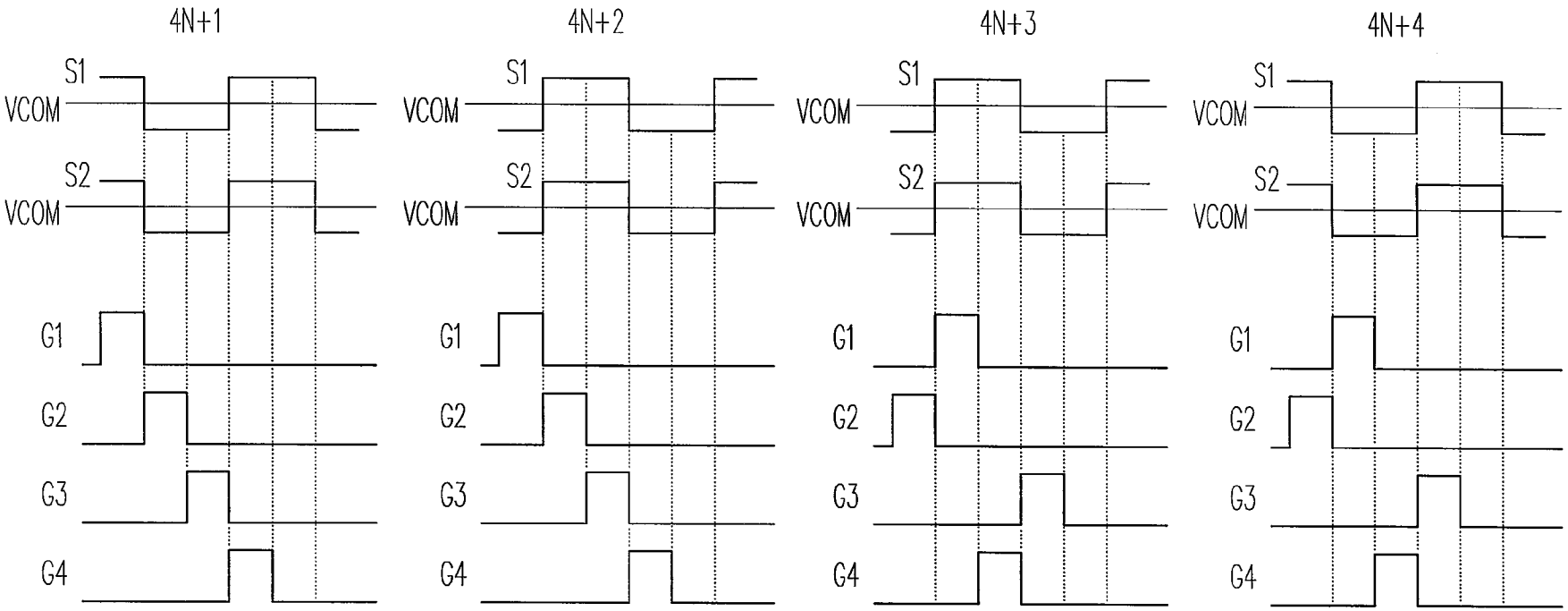
FIG. 8 is a method for driving a display panel according to yet another embodiment of the invention.
Figure 9:
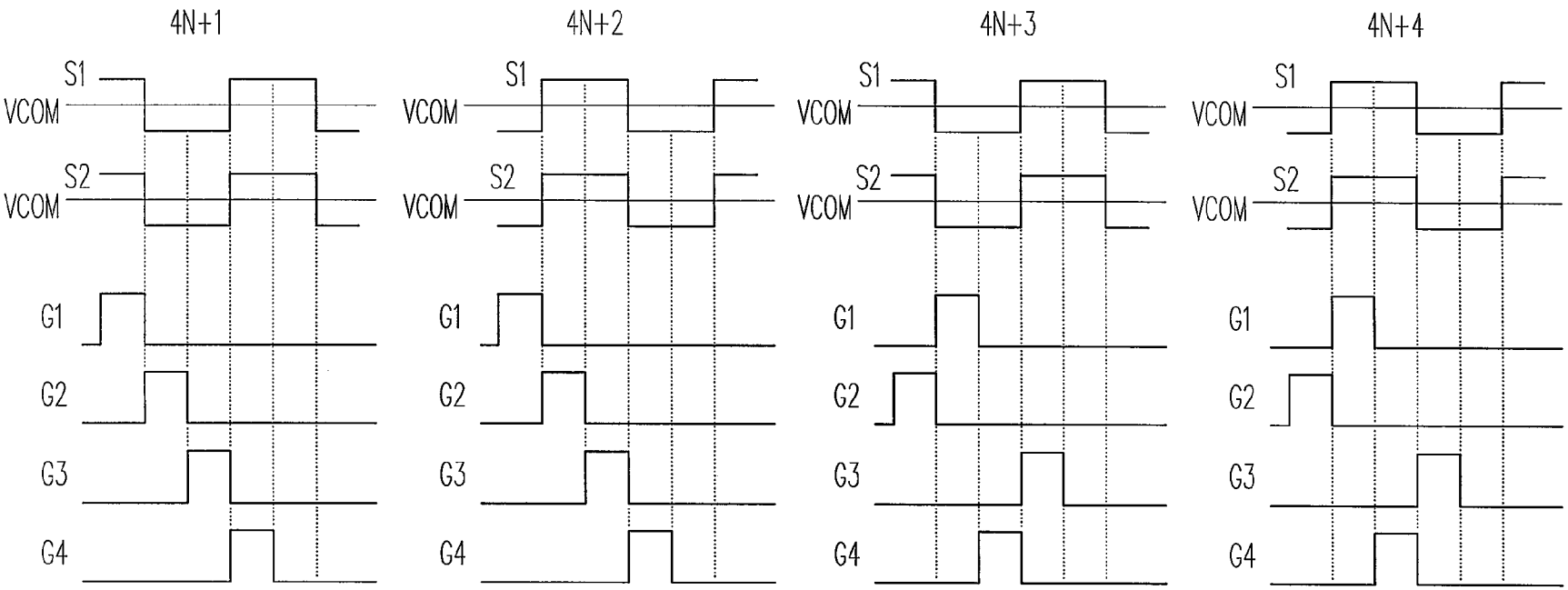
FIGS. 9-13 and 15-17 illustrate a method for driving a display panel according to another embodiment of the present invention.
Figure 10:
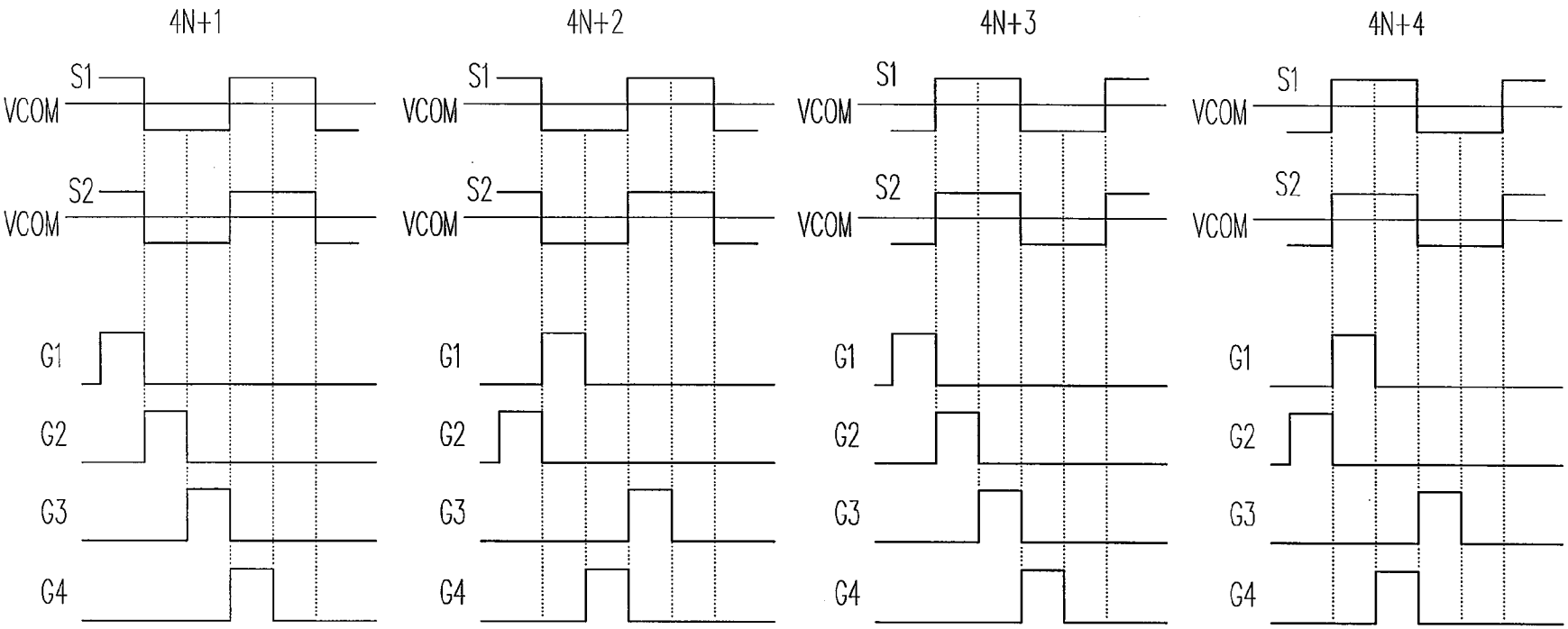
Figure 11:
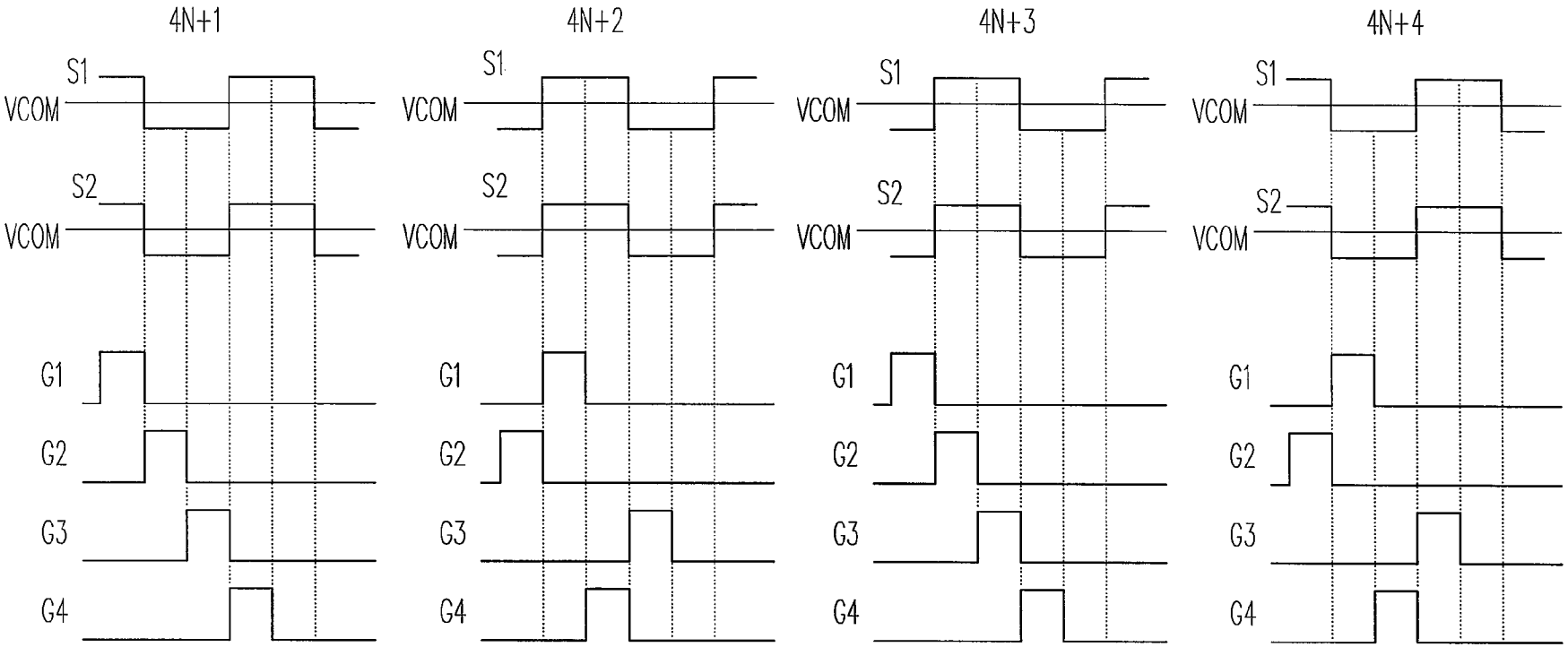
Figure 12:
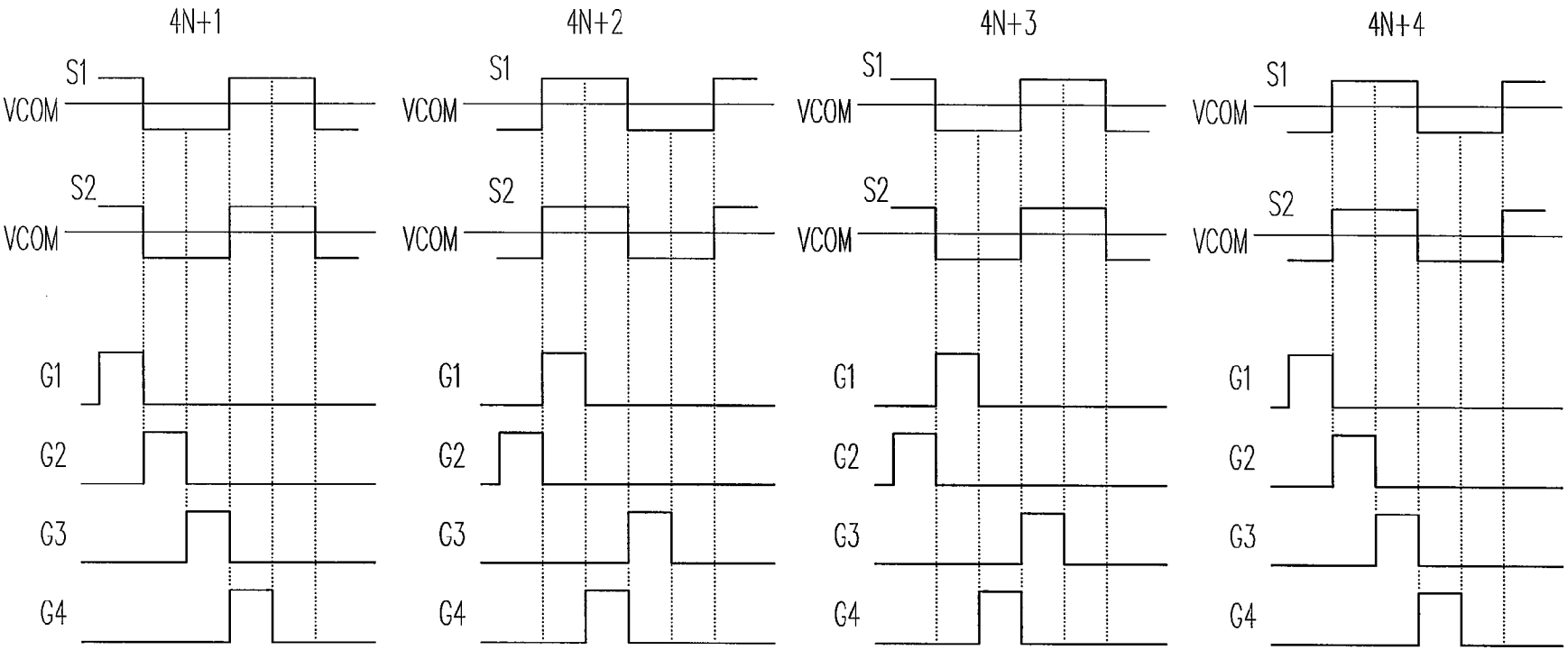
Figure 13:
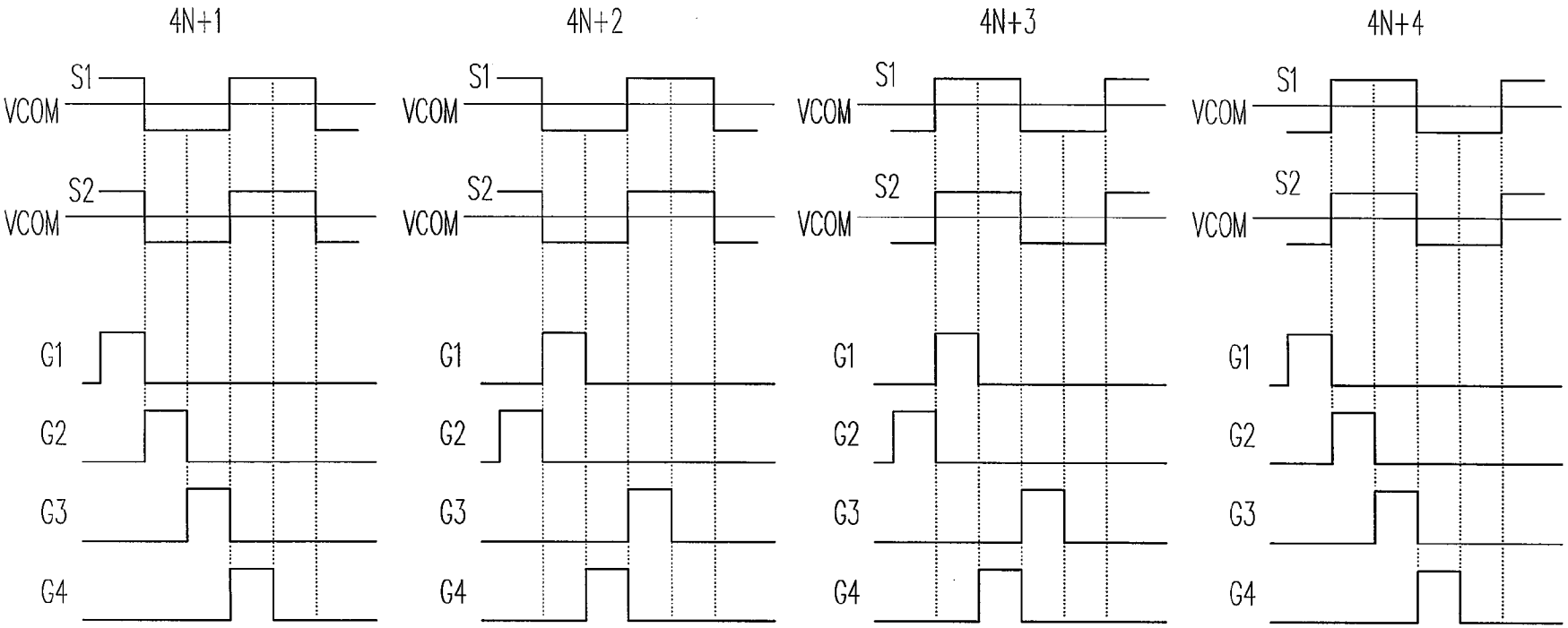

If a half-source-double-gate type panel adopts the dot inversion technique and a direct current common potential as shown in FIG. 4, then one of the solutions to the problem of vertical bright and dim stripes would be as shown in FIG. 8. FIG. 8 illustrates the polarities of the source lines S1 and S2 during the $4N+1^{th}$ to the $4N+4^{th}$ image durations and the driving sequences in which the gate lines G1-G4 are driven during the $4N+1^{th}$ to the $4N+4^{th}$ image durations according to a driving method of a display panel in yet another embodiment of the invention. Furthermore, the VCOM in FIG. 8 refers to a common potential, and all the other reference labels correspond to those in FIG. 4.

In FIG. 8, during the $4N+1^{th}$ and the $4N+2^{th}$ image durations, the gate lines G1-G4 are sequentially driven one by one. However, during the $4N+3^{th}$ and the $4N+4^{th}$ image durations, the driving sequence of the gate lines corresponding to the same scan line is changed. Hence, during the $4N+1^{th}$ and the $4N+2^{th}$ image durations, the voltage differences between the source lines S1, S2 and the common potential VCOM when the gate lines G2 and G4 are driven are smaller than the voltage differences between the source lines S1, S2 and the common potential VCOM when the gate lines G1 and G3 are driven. Similarly, during the $4N+3^{th}$ and the $4N+4^{th}$ image durations, the voltage differences between the source lines S1, S2 and the common potential VCOM when the gate lines G1 and G3 are driven are smaller than the voltage differences between the source lines S1, S2 and the common potential VCOM when the gate lines G2 and G4 are driven. It can be inferred that this operation method can mitigate the phenomenon of vertical bright and dim stripes derived from uneven brightness and dimness.

The dot technique may be implemented in a plurality of embodiments so it is difficult to enumerate every one of them. However, the user should be able to apply the spirit described in FIG. 8 to the other dot inversion techniques. Several other driving methods of the invention are further cited in the following in the hope of making the invention more comprehensible to the user, as shown in FIGS. 9-13. FIGS. 9-13 illustrate the polarities of the source lines S1 and S2 during the $4N+1^{th}$ to the $4N+4^{th}$ image durations, and the driving sequences of the gate lines G1-G4 during the $4N+1^{th}$ to the $4N+4^{th}$ image durations. Additionally, the VCOM in FIGS. 9-13 refers to a common potential, and all the other reference labels correspond to those in FIG. 4. The operation method shown in FIGS. 9-13 is rather similar to the operation method of FIG. 8. The method mainly changes (or exchanges) the sequences of the polarity changes in the voltage differences between the source lines S1, S2 and the common potential VCOM (as long as they comply with the change in the alternating current of the voltages on the two terminals of the liquid crystal) as well as the driving sequences of the gate lines G1-G4 so as to perform the driving of the display panel. Therefore, the embodiments of the invention are not limited to those shown in FIGS. 8-13. The user may infer from the foregoing embodiments and further apply them, which is not to be reiterated herein.

Figure 14:
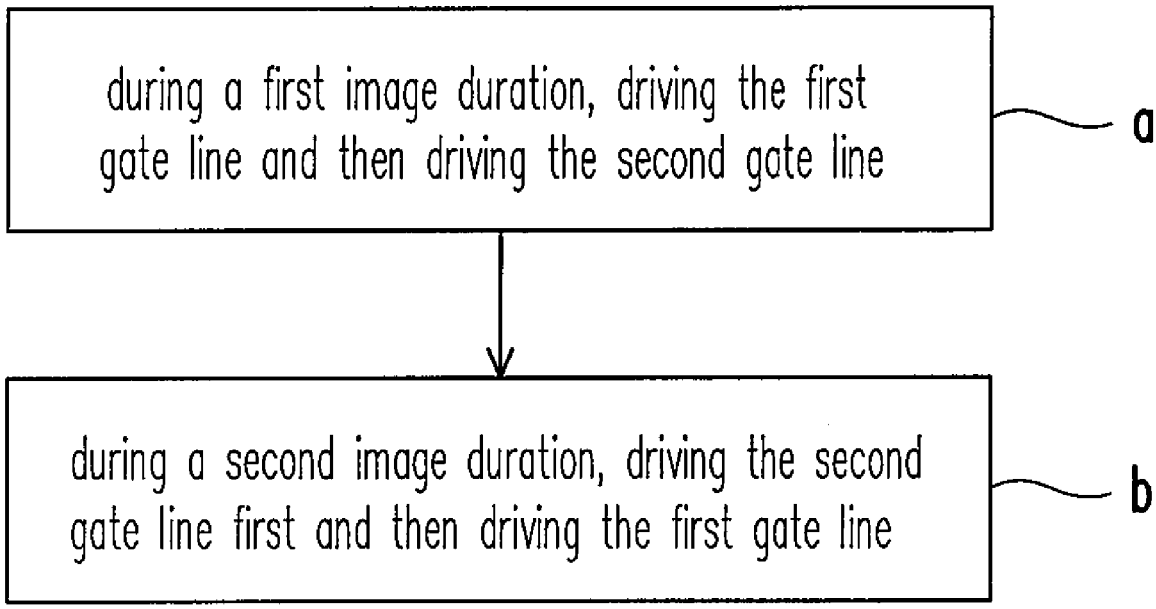
FIG. 14 is a flowchart of a method for driving a display panel according to one embodiment of the invention.

From the teachings and demonstrations of the above-mentioned embodiments, some basic operation methods can be concluded generally as shown in FIG. 14. FIG. 14 is a flowchart of the method for driving a display panel according to an embodiment of the present invention. The method includes the following steps. At the beginning, during a first image duration, a first gate line is driven first, and then a second gate line is driven (such as a step a). Afterwards, during a second image duration, the second gate line is driven first, and then the first gate line is driven (such as a step b).

Specifically, the foregoing embodiments adopting the line inversion technique all use an alternating current common potential to invert the polarity when a scan line is completed. Taking FIGS. 1 and 6 for example, completing a scan line must include the time for driving two gate lines. However, the signals transmitted through the common potential and the source lines of some half-source-double-gate type panels can be inverted once after half a scan line (the time for driving one gate line) is completed, which is coordinated with the change in the polarity of the common potential and the sequence of turning on the gate lines so as to achieve another form of dot inversion technique or column inversion technique. Yet these varied techniques are still suitable for the invention, as shown in FIGS. 15-17.

Figure 15:
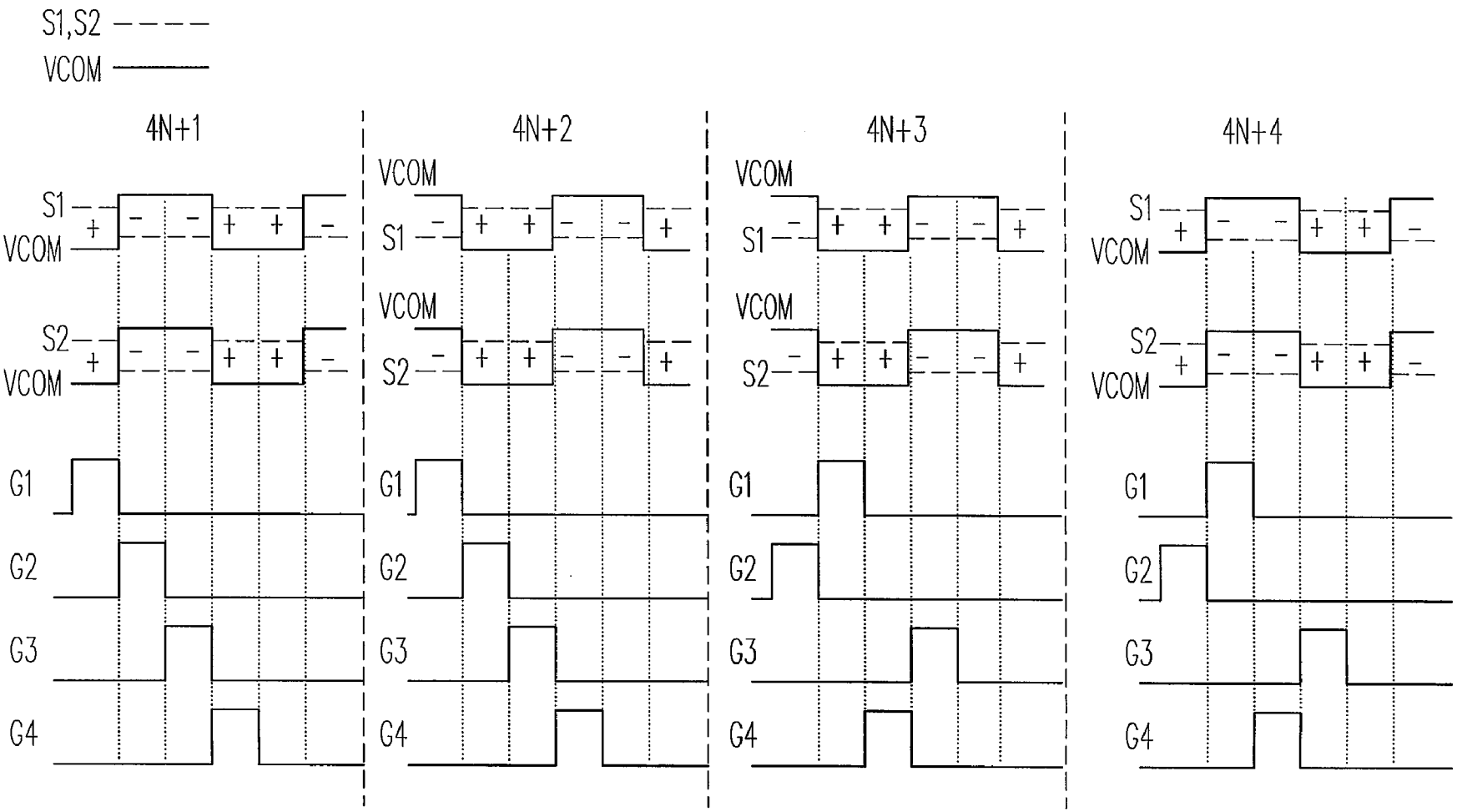
Figure 16:
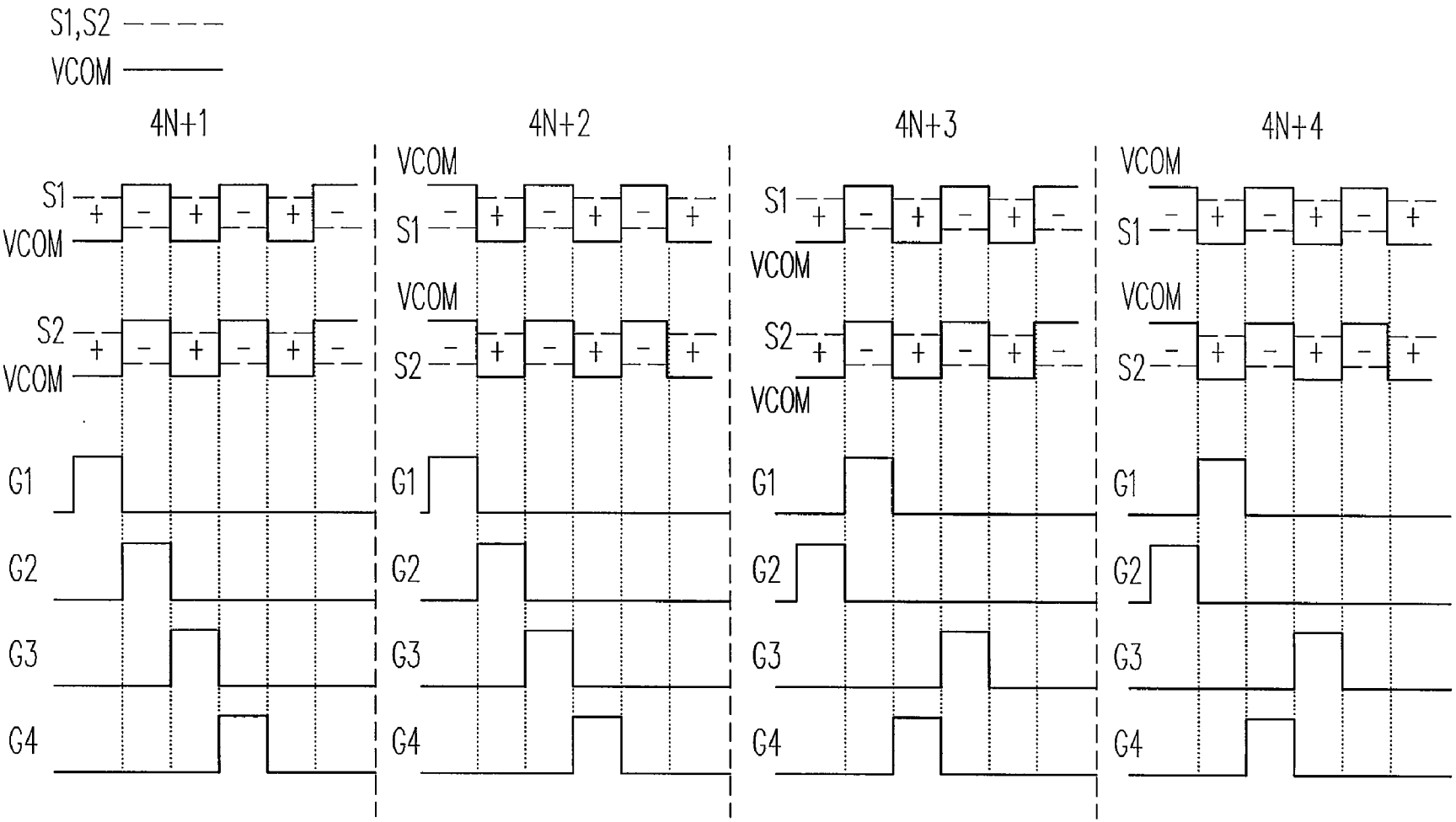
Figure 17:
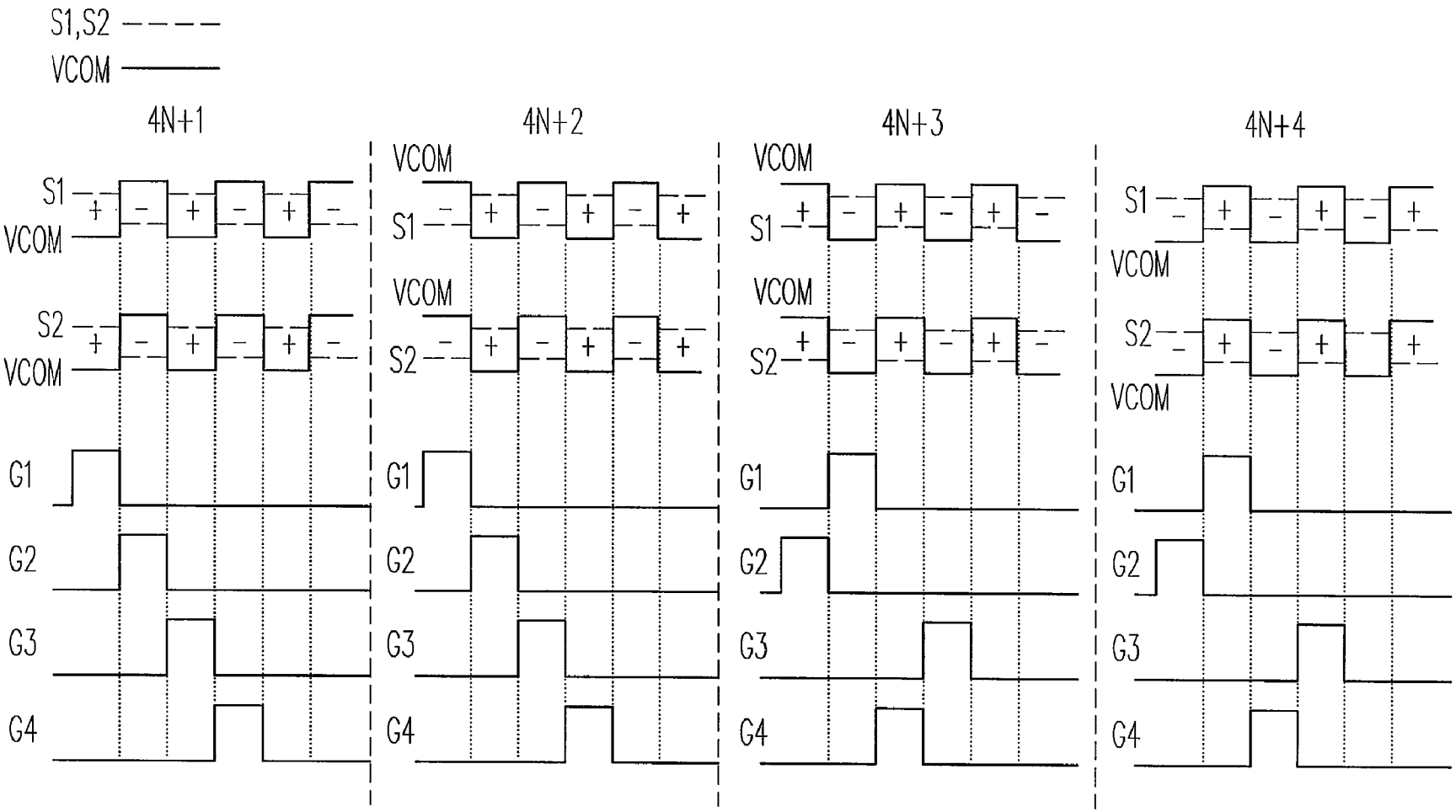

In order to facilitate illustration, all the panels taken as examples in FIGS. 15-17 adopt a normally black state as the display mode. Referring to FIG. 15 first, FIG. 15 illustrates an example of applying the invention according to one embodiment that adopts another form of dot inversion technique. FIG. 15 shows the polarities of the source lines S1, S2 and the common potential VCOM during the $4N+1^{th}$ to the $4N+4^{th}$ image durations, and the driving sequences of the gate lines G1-G4 during the $4N+1^{th}$ to the $4N+4^{th}$ image durations. Certainly, the method of using an alternating current common potential and an alternating current source line for transmission of signals to accomplish the dot inversion technique is not limited to the one shown in FIG. 15. Thus, the method shown in FIG. 15 should not be used to limit the present invention. In other words, the signal waveforms during the $4N+1^{th}$ to the $4N+4^{th}$ image durations as shown in FIG. 15 do not absolutely conform to the order of the $4N+1^{th}$, the $4N+2^{th}$, $4N+3^{th}$ and $4N+4^{th}$. The user may exchange the order of the four frames at will as long as the frames are operated according to the illustrated signal waveforms during the $4N+1^{th}$ to the $4N+4^{th}$ image durations and thereby obtaining the characteristic of polarity exchange required by the liquid crystal display and simultaneously mitigating the phenomenon of vertical bright and dim stripes caused by uneven brightness and dimness.

FIGS. 16 and 17 respectively illustrate examples of applying the present invention according to two of the embodiments adopting the foregoing column inversion technique. Both FIGS. 16 and 17 illustrate the polarities of the source lines S1, S2 and the common potential VCOM during the $4N+1^{th}$ to the $4N+4^{th}$ image durations, and the driving sequences of the gate lines G1-G4 during the $4N+1^{th}$ to the $4N+4^{th}$ image durations. Similarly, the method of using an alternating current common potential and an alternating current source line for transmission of signals to accomplish the column inversion technique is not limited to the methods shown in FIGS. 16 and 17. Thus, the methods shown in FIGS. 16 and 17 should not be used to limit the present invention. Alternatively speaking, the order of the signal waveforms during the $4N+1^{th}$ to the $4N+4^{th}$ image durations as shown in FIGS. 16 and 17 may be exchanged at will as long as the frames are operated according to the illustrated waveforms during the $4N+1^{th}$ to the $4N+4^{th}$ image durations and thereby obtaining the characteristic of polarity exchange required by the liquid crystal display and simultaneously mitigating the phenomenon of vertical bright and dim stripes caused by uneven brightness and dimness.

It should be emphasized again that exchanging the signal waveforms during the $4N+1^{th}$ to the $4N+4^{th}$ image durations shown in the figures of each of the foregoing embodiments would generate a plurality of different embodiments. All of these embodiments are included in the driving method disclosed by the present invention.

Although only a small portion of the structure in the half-source-double-gate type panel is used for illustration of each of the said embodiments, it should be easy for the user to infer from the above descriptions the operation method of the remaining structure in the half-source-double-gate type panel according to the spirit of the invention. Furthermore, the invention is not limited to usage in the normally black frame display mode. The user may also apply the invention to the normally white frame display mode according to the spirit of the invention. In addition, people ordinarily skilled in the art should know a half-source-double-gate type panel may adopt a direct current common potential or an alternating current common potential to operate, which if coordinated with the driving method of the gate lines and the change in the polarity of the common potential may combine various different operation methods, such as the line inversion technique, the dot inversion technique and the column inversion technique. Therefore, the above-mentioned embodiments should not be used to limit the invention. In summary, the spirit of the invention lies in that during one image duration, the corresponding gate lines of the same scan line are driven in an order, and during another image duration, the corresponding gate lines of the same scan line are driven in another order, which also falls within the scope over which the invention seeks protection.

In the present invention, the gate lines corresponding to the same scan line are driven in different sequences during different image durations and thereby mitigating the problem of vertical bright and dim stripes derived from uneven brightness and dimness. If the methods shown in FIGS. 6-13 and 15 are adopted, they can even offset the phenomenon of vertical bright and dim stripes.

Although the present invention has been disclosed above by the preferred embodiments, they are not intended to limit the present invention. Anybody skilled in the art can make some modifications and alterations without departing from the spirit and scope of the present invention. Therefore, the protecting range of the present invention falls in the appended claims.

What is claimed is:

1. A method for driving a display panel, the display panel comprising a first scan line, the first scan line comprising a plurality of sub-pixels, a first portion of the sub-pixels controlled by a first gate line, a second portion of the sub-pixels controlled by a second gate line, wherein the sub-pixels of the first portion and the sub-pixels of the second portion are in an interlaced arrangement, the method comprising the following steps:

a. during a first image duration, driving the first gate line and then driving the second gate line; and b. during a second image duration, driving the second gate line first and then driving the first gate line.

2. The method as claimed in claim 1, wherein the polarities of the alternating current common potential of the first scan line during the first and the second image durations are the same.

3. The method as claimed in claim 1, wherein the step a further comprises: when driving the first gate line, transmitting the frame signals corresponding to the first portion of the sub-pixels to the first portion of the sub-pixels; when driving the second gate line, transmitting the frame signals corresponding to the second portion of the sub-pixels to the second portion of the sub-pixels.

4. The method as claimed in claim 3, wherein the step b further comprises: when driving the second gate line, transmitting the frame signals corresponding to the second portion of the sub-pixels to the second portion of the sub-pixels; when driving the first gate line, transmitting the frame signals corresponding to the first portion of the sub-pixels to the first portion of the sub-pixels.

5. The method as claimed in claim 1, wherein the second image duration follows the first image duration, a third image duration precedes the first image duration, and a fourth image duration follows the second duration, during the third image duration, first driving the first gate line and then driving the second gate line, during the fourth image duration, first driving the second gate line and then driving the first gate line.

6. The method as claimed in claim 5, wherein the polarities of the alternating current common potential of the first scan line during the second and the third image durations are the same, the polarities during the first and the fourth image durations being the same, the polarities during the first and the second image durations being different.

7. The method as claimed in claim 5, during the first image duration, the second image duration, the third image duration and the fourth image duration, when driving the first gate line, transmitting the frame signals corresponding to the first portion of the sub-pixels to the first portion of the sub-pixels, when driving the second gate line, transmitting the frame signals corresponding to the second portion of the sub-pixels to the second portion of the sub-pixels.

8. The method as claimed in claim 1, wherein the second image duration follows the first image duration, a third image duration precedes the first image duration, and a fourth image duration follows the second image duration, during the third image duration, first driving the second gate line then driving the first gate line, during the fourth image duration, first driving the first gate line then driving the second gate line.

9. The method as claimed in claim 8, wherein the polarities of the alternating current common potential of the first scan line during the first and the third image durations are the same, the polarities during the second and the fourth image durations being the same, the polarities during the first and the second image durations being different.

10. The method as claimed in claim 8, during the first image duration, the second image duration, the third image duration and the fourth image duration, when driving the first gate line, transmitting the frame signals corresponding to the first portion of the sub-pixels to the first portion of the sub-pixels, when driving the second gate line, transmitting the frame signals corresponding to the second portion of the sub-pixels to the second portion of the sub-pixels.

11. The method as claimed in claim 5, wherein the display panel further comprises a second scan line and the second scan line comprises a plurality of sub-pixels, the sub-pixels divided into a third portion and a fourth portion, the third portion controlled by a third gate line, the fourth portion controlled by a fourth gate line, the third and the fourth portions of the sub-pixels being in an interlaced arrangement; during the first and the third image durations, first driving the third gate line and then driving the fourth gate line; during the second and the fourth image durations, first driving the fourth gate line and then driving the third gate line.

12. The method as claimed in claim 11, wherein the common potential of the first scan line and the second scan line is a direct current common potential; during the second and the third image durations, the frame signals transmitted to the first and the fourth portions of the sub-pixels being a first polarity, the frame signals transmitted to the second and the third portions of the sub-pixels being a second polarity; during the first and the fourth image durations, the frame signals transmitted to the first and the fourth portions of the sub-pixels being the second polarity, the frame signals transmitted to the second and the third portions of the sub-pixels being the first polarity.

13. The method as claimed in claim 12, wherein the first polarity is the positive polarity and the second polarity is the negative polarity.

14. The method as claimed in claim 11, wherein the common potential of the first scan line and the second scan line is a direct current common potential; during the first and the second image durations, the frame signals transmitted to the first and the fourth portions of the sub-pixels being a first polarity, the frame signals transmitted to the second and the third portions of the sub-pixels being a second polarity; during the third and the fourth image durations, the frame signals transmitted to the first and the fourth portions of the sub-pixels being the second polarity, the frame signals transmitted to the second and the third portions of the sub-pixels being the first polarity.

15. The method as claimed in claim 14, wherein the first polarity is the negative polarity and the second polarity is the positive polarity.

16. The method as claimed in claim 1, wherein the second image duration follows the first image duration, a third image duration follows the second image duration, and a fourth image duration follows the third image duration; during the third image duration, first driving the first gate line and then driving the second gate line; during the fourth image duration, first driving the second gate line and then driving the first gate line.

17. The method as claimed in claim 16, wherein the display panel further comprises a second scan line and the second scan line comprises a plurality of sub-pixels, the sub-pixels divided into a third portion and a fourth portion, the third portion controlled by a third gate line, the fourth portion controlled by a fourth gate line, the third and the fourth portions of the sub-pixels being in an interlaced arrangement; during the first and the third image durations, first driving the third gate line and then driving the fourth gate line; during the second and the fourth image durations, first driving the fourth gate line and then driving the third gate line.

18. The method as claimed in claim 17, wherein the common potential of the first scan line and the second scan line is a direct current common potential; during the first and the fourth image durations, the frame signals transmitted to the first and the fourth portions of the sub-pixels being a first polarity, the frame signals transmitted to the second and the third portions of the sub-pixels being a second polarity; during the second and the third image durations, the frame signals transmitted to the first and the fourth portions of the sub-pixels being the second polarity, the frame signals transmitted to the second and the third portions of the sub-pixels being the first polarity.

19. The method as claimed in claim 18, wherein the first polarity is the positive polarity and the second polarity is the negative polarity.

20. The method as claimed in claim 17, wherein the common potential of the first scan line and the second scan line is a direct current common potential; during the first and the second image durations, the frame signals transmitted to the first and the fourth portions of the sub-pixels being a first polarity, the frame signals transmitted to the second and the third portions of the sub-pixels being a second polarity; during the third and the fourth image durations, the frame signals transmitted to the first and the fourth portions of the sub-pixels being the second polarity, the frame signals transmitted to the second and the third portions of the sub-pixels being the first polarity.

21. The method as claimed in claim 20, wherein the first polarity is the positive polarity and the second polarity is the negative polarity.

22. The method as claimed in claim 1, wherein the second image duration follows the first image duration, a third image duration follows the second image duration, and a fourth image duration follows the third image duration; during the third image duration, first driving the second gate line and then driving the first gate line; during the fourth image duration, first driving the first gate line and then driving the second gate line.

23. The method as claimed in claim 22, wherein the display panel further comprises a second scan line and the second scan line comprises a plurality of sub-pixels, the sub-pixels divided into a third portion and a fourth portion, the third portion controlled by a third gate line, the fourth portion controlled by a fourth gate line, the third and the fourth portions of the sub-pixels being in an interlaced arrangement; during the first and the fourth image durations, first driving the third gate line and then driving the fourth gate line; during the second and the third image durations, first driving the fourth gate line and then driving the third gate line.

24. The method as claimed in claim 23, wherein the common potential of the first scan line and the second scan line is a direct current common potential; during the first and the second image durations, the frame signals transmitted to the first and the fourth portions of the sub-pixels being a first polarity, the frame signals transmitted to the second and the third portions of the sub-pixels being a second polarity; during the third and the fourth image durations, the frame signals transmitted to the first and the fourth portions of the sub-pixels being the second polarity, the frame signals transmitted to the second and the third portions of the sub-pixels being the first polarity.

25. The method as claimed in claim 24, wherein the first polarity is the positive polarity and the second polarity is the negative polarity.

26. The method as claimed in claim 23, wherein the common potential of the first scan line and the second scan line is a direct current common potential; during the first and the third image durations, the frame signals transmitted to the first and the fourth portions of the sub-pixels being a first polarity, the frame signals transmitted to the second and the third portions of the sub-pixels being a second polarity; during the second and the fourth image durations, the frame signals transmitted to the first and the fourth portions of the sub-pixels being the second polarity, the frame signals transmitted to the second and the third portions of the sub-pixels being the first polarity.

27. The method as claimed in claim 26, wherein the first polarity is the positive polarity and the second polarity is the negative polarity.

28. The method as claimed in claim 1, wherein the display panel comprises a liquid crystal display (LCD) panel.

29. The method as claimed in claim 1, wherein the displayed color of each of the sub-pixels is different from the displayed colors of the adjacent sub-pixels.

* * * * *